US005865380A

United States Patent [19]

Kazama et al.

[11] Patent Number: 5,865,380

[45] Date of Patent: Feb. 2, 1999

[54] ROTARY ATOMIZING ELECTROSTATIC COATING APPARATUS

[75] Inventors: Shigenori Kazama; Ryo Sasaki; Kayo Kubota; Akihiko Aizawa, all of Kanagawa-ken, Japan

[73] Assignee: Nissan Motor Co., Ltd., Yokohama, Japan

[21] Appl. No.: 739,438

[22] Filed: Oct. 29, 1996

[30] Foreign Application Priority Data

Nov. 9, 1995 [JP] Japan ..... 7-291394

[51] Int. Cl.[6] ..... B05B 5/00

[52] U.S. Cl. ..... 239/704; 239/703; 239/707

[58] Field of Search ..... 239/222.11, 223, 239/224, 691, 699, 700, 703, 704, 706, 707, 708

[56] References Cited

U.S. PATENT DOCUMENTS

| | | | |
|---|---|---|---|
| 2,710,773 | 6/1955 | Sedlacsik | 239/707 |
| 2,890,388 | 6/1959 | Croskey et al. | 239/704 X |
| 2,993,468 | 7/1961 | Zmuda et al. | 239/700 X |
| 3,009,441 | 11/1961 | Juvinall | 239/691 X |
| 3,408,985 | 11/1968 | Sedlacsik, Jr. | 239/706 X |

FOREIGN PATENT DOCUMENTS 865768 3/1957 United Kingdom .

*Primary Examiner*—Andres Kashnikow
*Assistant Examiner*—Steven J. Ganey
*Attorney, Agent, or Firm*—Foley & Lardner

[57] ABSTRACT

A rotary atomizing electrostatic coating apparatus having a rotating spray head, and a paint nozzle for feeding paint on the front surface of the spray head, in which the spray head is comprising a spray head main body made of an electrically insulating material, and a plurality of discharge electrodes having nearly band-form pattern extending outward approximately along the rear side shape of the spray head main body from the central side of the spray head main body with a mutual phase difference or extending symmetrically about the axis of rotation of the spray head main body. The plurality of discharge electrodes rotate together with the spray head main body, and the discharge current in the front side direction of the axis of rotation of the spray head is made uniform and increased, thereby enhancing the painting efficiency.

10 Claims, 5 Drawing Sheets

ROTARY ATOMIZING ELECTROSTATIC COATING APPARATUS

BACKGROUND OF THE INVENTION

1. Field of the Invention

The present invention relates to a rotary atomizing electrostatic coating apparatus, and more particularly to a rotary atomizing electrostatic coating apparatus having a structure capable of increasing uniformly discharge current formed in a front area portion of rotary shaft of a spray head.

2. Description of the Prior Art

An electrostatic coating method is a method of using a grounded object as anode and coating apparatus as cathode, applying a high negative voltage thereto to form an electrostatic field between the two electrodes, charging sprayed paint particles negatively, and adhering the paint efficiently on the object of the opposite polarity. Setting of the object as anode and painting apparatus as cathode is based on the practical safety precaution that spark discharge hardly occurs as compared with reverse polarity.

The electrostatic coating apparatus may be roughly classified into two types: one is a rotary atomizing electrostatic coating apparatus for pulverizing the paint by the force of rotation and static electricity, and adhering paint particles on the object by electrostatic attraction, and other is a gun type apparatus for pulverizing the paint by the force of compressed air, or high paint pressure or mechanical force, and charging the pulverized paint electrically and adhering to the object by electrostatic attraction.

The invention relates to the former type of rotary atomizing electrostatic coating apparatus. In the rotary atomizing electrostatic apparatus, generally, the paint is atomized by centrifugal force of spray head such as rotating metallic cup (or "bell"), disk or the like, and a high voltage is applied to such metallic spray head in order to charge the paint electrically and form an electrostatic field. Because this cup has relatively excellent characteristics satisfying functions of atomizing the paint, and maintaining an electrostatic field opposite to the object, simultaneously, the rotary atomizing electrostatic coating apparatus is known as a coating apparatus exhibiting a high paint deposition efficiency.

More specifically, the leading end part of a conventional rotary atomizing electrostatic coating apparatus comprises a metal cup as a spray head fixed to the leading end of a hollow shaft of a motor incorporated inside the apparatus. Inside the hollow shaft, a paint nozzle communicating with a paint pump is disposed coaxially. The top of the paint nozzle reaches up to the inside of the metal cup, and communicates with paint outlet holes formed around the central position of the front side of the cup (multiple pores are disposed annularly as the paint outlet holes). At the rear side of the cup, an air ring is provided coaxially to enclose the outer circumference of the hollow shaft at a specific spacing—inside the air ring are formed many air outlet holes opened towards the rear side of the cup. The air outlet holes communicate to an air feed pump through an air lead-in port opening located at the side face of the air ring. The hollow shaft is electrically connected to a high voltage generator through cables, and a specific voltage can be applied to the cup communicating with the hollow shaft.

In this apparatus, the paint fed through rear end of the hollow shaft is supplied into the front plane of the metal cup through the paint outlet holes. Since this metal cup as spray head is rotated at high speed by the motor, the paint supplied to the front plane of the metal cup is drawn thinly along the front plane formed on the front side of the metal cup by the centrifugal force, and comes opposite to the outer peripheral edge of the metal cup, and is released in atomized form through the outer peripheral edge of the metal cup. The released paint particles are controlled into a specific pattern by pattern adjusting air ejected from the air outlet holes of the air ring disposed at the rear side of the cup, and carried into the direction of the object. On the other hand, since a high voltage is applied to the metal cup, corona discharge is occurred from the leading end of the metal cup toward the object. The paint particles released from the metal cup are further charged by the corona discharge, aside from the electric charge obtained by contacting with the metal cup, and thus charged paint particles are adhered to the object efficiently by Coulomb's force.

In such conventional rotary atomizing electrostatic spraying apparatus, hitherto, the spray head is a metal cup made of high conductivity material such as chrome steel, stainless steel, and aluminum alloy, as mentioned above. Since the metal cup function as discharge electrode, at a glance, these metals are appeared to be a rational materials.

As a result of investigations by the present inventor, however, in the rotary atomizing electrostatic coating apparatus having such metallic spray head, the discharge. current cannot be adjusted, and it was found difficult to enhance the paint deposition efficiency further. That is, in the conventional rotary atomizing electrostatic coating apparatus having such metallic spray head, atomization of paint was found to cause the reduction of the corona discharge current. This is considered because the atomized paint particles have an electrostatic shielding effect.

SUMMARY OF THE INVENTION

It is hence an object of the invention to present an improved rotary atomizing electrostatic coating apparatus. It is also an object of the invention to present a rotary atomizing electrostatic coating apparatus capable of increasing uniformly the discharge current in the front area portion of a rotary shaft of a spray head, and improving the painting efficiency.

The inventors, as a result of intensive research for solving the problems in the conventional apparatus as mentioned above, accomplished an improvement of the structure of the spray head, such as cup 2 shown in FIG. 1. Namely, by using the spray head main body made of an electrically insulating material, and disposing a discharge electrode 8 of a specific shape at the rear side of this electrically insulating spray head main body, comparing with the case of the spray head made of conductive material, the inventors have discovered that the corona discharge current during the atomizing process of the metallic paint could be increased. Moreover, by modifying the shape of the discharge electrode 8 located at the rear side of the spray head main body 2, the distribution pattern of discharge current toward the object was averaged, and in particular it was found that the discharge current formed in the front area portion of the rotary shaft of the spray head main body 2 can be increased, thereby leading to the present invention.

That is, the present invention to solve the above problems relates to a rotary atomizing electrostatic coating apparatus having a specific rotating spray head main body 2 as shown in FIG. 1. The rotary atomizing electrostatic coating apparatus further comprising means for feeding paint onto the front plane of the spray head 2, in which the spray head is made of electrically insulating material, and (at the rear side of the spray head 2) a plurality of discharge electrodes 8 formed in band patterns extending outward almost along the rear shape of the spray head main body from the central side of the spray head, disposed at a mutual specific phase difference around the rotary shaft of the spray head as shown in FIG. 2 and FIG. 4. And these plurality of discharge electrodes rotate together with the spray head main body. The specific phase difference is preferred to be a phase difference of equal interval, such as two pieces at phase difference of 180- and six pieces at phase difference of 60-. The discharge electrodes may be formed either in contact with the rear side of the spray head main body 2 as shown in FIG. 1, or substantially as different bodies 18 at a spacing from the spray head main body 2 as shown in FIG. 8.

When painted by using the rotary atomizing electrostatic coating apparatus of the invention having such constitution, as compared with the case of using the conventional rotary atomizing electrostatic coating apparatus having a metallic spray head, (1) the corona discharge current increases when atomizing the paint, and (2) the distribution pattern of discharge current towards the object is considerably averaged, and the discharge current formed in the front area of the rotary portion of the spray head main body particularly increases, and thereby the paint deposition efficiency is enhanced.

Incidentally, the phenomenon of (1) is considered to be derived from the specific action, which is attributable to the constitution comprising the spray head main body by using an electrically insulating material and the electrodes disposed at the rear side of the spray head main body; superior action as compared with the case of metallic spray head or the entirely conductive spray head. Furthermore, by disposing the electrodes locally, without forming on the whole circumferential area around the rotary shaft of the spray head (that is, on the entire rear side of the spray head main body such as cylindrical or disk form), more specifically, by disposing a plurality of electrodes formed nearly in band-form pattern extending outward almost along the rear shape of the spray head main body from the central side of the spray head, at a mutual phase difference around the rotary shaft of the spray head, it is considered that the phenomenon of (2) is further induced.

The number of discharge electrodes of the invention may be 2 to 12, more preferably 6 or 2. If the number of electrodes is more than 12, as shown in FIGS. 5 and 6, any particular advantageous effect is not obtained, as compared with the case of using metallic spray head in the prior art, or the case of disposing discharge electrodes in such a shape as cylindrical or disk form to cover the entire rear surface of the insulating spray head main body. The reason for excluding only one as the number of discharge electrodes is that, as shown in FIG. 5, in the case of one electrode only, the discharge current is more likely to decrease as compared with the case of the prior art: disposing a discharge electrode having a surface extended in the whole direction around the rotary shaft of the spray head.

In the present invention, moreover, plural discharge electrodes 8 are preferred to be connected to a common high voltage generator through mutually independent resistances of 10 kΩ to 500 MΩ. By applying a high voltage through the specific resistances to the plural discharge electrodes 8, respectively, it can avoid the problem of potential drop due to an extraordinary corona discharge current generated in specific one electrode, while other electrodes fail to reach the corona discharge sufficiently, so that stable corona discharge current may be obtained.

In the invention, the tip of such discharge electrodes 8, 18 is preferred to be extended up to the outer peripheral edge of the spray head main body 2. If the tip of the discharge electrode is terminated considerably before (central side) the outer peripheral edge of the spray head main body 2, it is hard to charge the atomized paint particles sufficiently, and the diameter of the discharge region formed on the front area portion of the spray head main body becomes smaller. Still more, the width of the tip of the discharge electrodes 8, 18 is preferred to be ⅕ or less of the diameter of the spray head main body 2. If the width of the tip of the discharge electrodes 8, 18 is wider than necessary, uniformalization of the distribution pattern of discharge current towards the object cannot be expected.

Other and further objects and features of the present invention will become obvious upon an understanding of the illustrative embodiments about to be described in connection with the accompanying drawings or will be indicated in the appended claims, and various advantages not referred to herein will occur to one skilled in the art upon employing of the invention in practice.

DETAILED DESCRIPTION OF THE EMBODIMENTS

Figure 1:
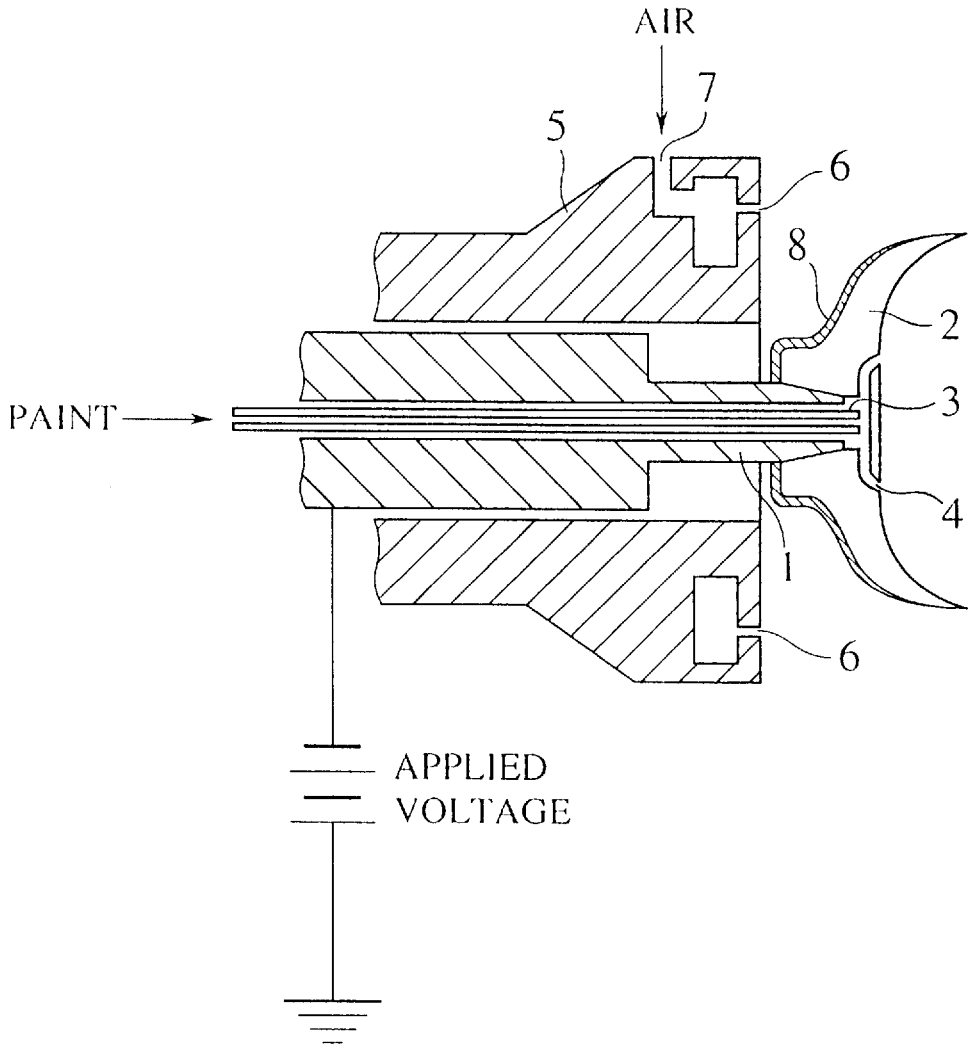
FIG. 1 is a schematic cross-sectional view of a leading end part of a rotary atomizing electrostatic coating apparatus according to a first embodiment of the invention.

Various embodiments of the present invention will be described with reference to the accompanying drawings. It is to be noted that the same or similar reference numerals are applied to the same or similar parts and elements throughout the drawings, and the description of the same or similar parts and elements will be omitted or simplified.

(First embodiment)

The rotary atomizing electrostatic coating apparatus of the first embodiment of the present invention is essentially same as the conventional rotary atomizing electrostatic coating apparatus, except that the metallic spray head of the conventional rotary atomizing electrostatic coating apparatus is replaced by a spray head main body made of an insulating material, and that discharge electrodes of specified shape as described below are disposed at the rear side thereof. Therefore, the apparatus of the first embodiment of the invention can be applied in any hitherto known mode of the rotary atomizing electrostatic coating apparatus, only by adding the above modification.

Figure 2:
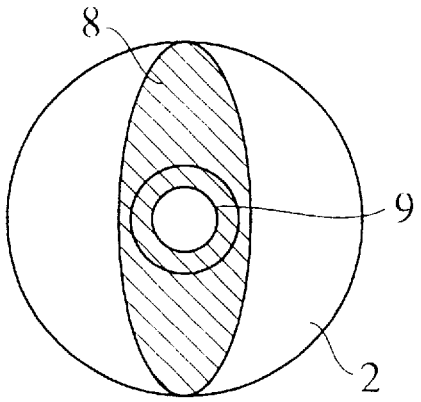
FIG. 2 is a back side view of a cup in the first embodiment.
Figure 3:
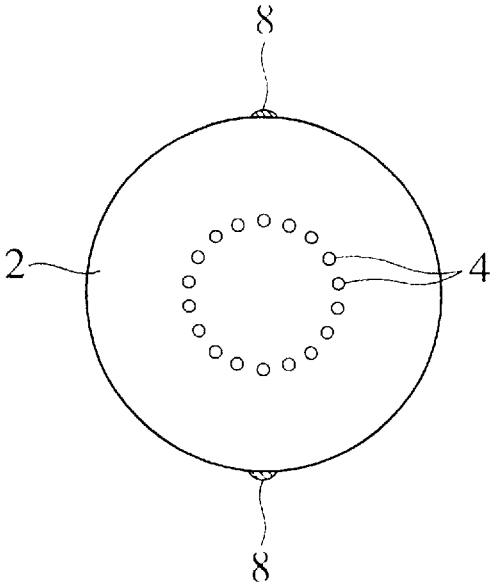
FIG. 3 is a front view of the cup in the first embodiment.

FIG. 1 is a schematic cross-sectional view showing the structure of the leading end part of the rotary atomizing electrostatic coating apparatus in the first embodiment of the present invention, and FIG. 2 is a back side view of a cup as a spray head in the first embodiment, and FIG. 3 is a front view of the cup in the first embodiment.

In the apparatus of the first embodiment shown in FIGS. 1 to 3, at the leading end of a hollow shaft 1 of a motor incorporated in the apparatus, a cup 2 made of an insulating material to be used as a spray head main body is fixed. And a paint nozzle 3 communicating with a paint pump not shown is disposed coaxially inside the hollow shaft 1, and the top of the paint nozzle 3 is located in the cup 2 made of insulating material. Further, the top of the paint nozzle 3 communicates with paint outlet holes (multiple pores disposed annularly) opened around the central position of the front side of the cup 2. At the rear side of the cup 2, an air ring 5 enclosing coaxially the outer circumference of the hollow shaft 1 at a specific spacing is provided. And at the surface of this air ring 5 are formed multiple air outlet holes 6, which are opened toward the rear side of the cup 2. Further, a ring-shaped manifold, linking with an air lead-in port 7, is disposed on the side surface side of the air ring 5, and this air lead-in port 7 communicates with an air feed pump (although the manifold and the air feed pump are not shown in FIG. 1). In this first embodiment, at the rear side of the cup 2 made of insulating material, a conductive film 8 made of conductive paint having a shape as shown in FIG. 2 is fixed. Namely, thereby two discharge electrodes 8 are formed symmetrically about the axis of rotation of the spray head main body 2. The conductive film 8 is, as clear from FIG. 2 and FIG. 3, formed up to the outer peripheral edge of the cup 2, and therefore the tips, or the leading ends of the two discharge electrodes, having a mutual phase difference of about 180 degrees, exist protruding from the outer peripheral edge of the cup 2. The width of the protruding tips of the discharge electrodes is 1/25 of the cup outer diameter.

On the other hand, the conductive film 8 is, as shown in FIG. 2, disposed also on the peripheral region of an insert port 9 provided in the center of the cup 2. In the insert port 9, the leading end of the hollow shaft 1 is inserted, and the conductive film 8 is electrically connected to the hollow shaft 1. Since the hollow shaft 1 is electrically connected to a high voltage generator (not shown) through cable, a predetermined voltage is applied to the conductive film 8 electrically connected with the hollow shaft 1. That is, the predetermined voltage is applied to the two discharge electrodes.

In this apparatus, the paint is supplied from the paint outlet holes 4 to the front plane of the cup 2 (cup inside) through the paint nozzle 3 positioned coaxially in the center axis of rotation of the cup. Since this cup is rotated at high speed by a motor, the paint supplied to the cup front plane is drawn thinly along the cup front plane by the centrifugal force, and is directed to the cup outer peripheral edge, and is released in atomized form from the cup outer peripheral edge. The released paint particles are controlled in a specific pattern by a pattern adjusting air ejected from the air outlet holes 6 at the air ring 5, and carried into the direction of the object. On the other hand, since a high voltage is applied to the discharge electrodes formed by the conductive film 8 provided at the back side of the cup 2 made of insulating material, corona discharge is occurred almost stationarily toward the object from the tips of the discharge electrodes protruding at two positions on the outer peripheral edge of the cup 2. The discharge electrodes are rotating simultaneously with rotation of the cup, so that a discharge current toward the object is formed in the entire front area of the cup periphery. Meanwhile, since the corona discharge positions are substantially limited only to the tips of the discharge electrodes (two positions at a mutual phase difference of 180 degrees on the cup outer peripheral edge), and the discharge electrodes are rotating, the distribution pattern of discharge currents formed on the cup front area is averaged in a macroscopic view of time.

Paint particles atomized at the cup outer peripheral edge and popping out to the forward space are charged by this corona discharge, and the charged paint particles are adhered to the object efficiently by Coulomb's force.

The spray head main body 2 used in the rotary atomizing electrostatic painting apparatus of the first embodiment shown in FIG. 1 to FIG. 3 is made of an insulating material. The insulating material for composing the spray head main body 2 is not particularly limited as far as having a sufficient electric insulation and durability against paint material to be used, especially the solvents, and although variable with the kind of the paint composition to be used, usable examples include polycarbonate; polyamide such as nylon; polyolefin such as polypropylene and polyethylene; polystyrene; ABS resin; polyethylene terephthalate; polybutylene terephthalate; rigid vinyl chloride resin; poly (meth)acrylic resin; polyacetal, denatured polyphenylene oxide; polyphenylene sulfide; polysulfone; polyether sulfone; polyimide; ketone polymer such as polyether ketone and polyether ether ketone; fluorine polymer such as polychlorotrifluoroethylene, tetrafluoroethylenehexafluoropropylene copolymer and polyvinylidene fluoride; epoxy resin; unsaturated polyester resin; phenol resin; and various synthetic resins such as melamine resin (also including their reinforced matter by glass fiber or other insulating filler, their polymer alloy, laminates, etc.). It may be also composed of alumina, beryllia, zircon, mulite, steatite, forsterite, silicon oxide, silicon nitride, boron nitride, and other ceramics; and quartz glass and other insulating inorganic materials. Of course it may be composed of a compound or laminate of such synthetic resin and inorganic material, and further metal, carbon or other conductive material may be used inside for the purpose of reinforcement or other as far as the electric insulation of the outer surface side is sufficiently maintained. Of these insulating materials, considering the durability, mechanical strength and economy, for example, polyether ether ketone is a particularly preferred material.

The shape of the spray head main body 2 composed of such insulating material is not limited to the shape shown in FIGS. 1 to 3, but may be same as the hitherto known shape of metallic spray head, depending on the painting configuration such as the shape of the object to be painted. The hitherto known shape of spray head includes cup (bell), and disk, and the cup shape includes standard bell of standard size, mini bell of small size used at high rotating speed, and color change bell easy to change colors, and the disk type includes standard disk of almost flat disk shape, and well feed type having a paint sump in the center of the disk, and the spray head used in the rotary atomizing electrostatic coating apparatus in the first embodiment of the invention may be shaped in any one of such known shapes as far as it is composed of the insulating material specified above. Therefore, in FIGS. 1 to 3, only the cup shaped spray head is shown, but same effects are expected in the disk or other shapes.

The discharge electrodes 8 formed by contacting directly with the rear side of the spray head main body 2 are not particularly limited. Aside from the specified conductive paint, for example, they may be also formed of metal deposition film, deposition film of conductive metal oxide, electroless plated film, sputtering film, CVD film and other materials. Of course, a thin metal sheet may be adhered. In particular, by using conductive film, electrodes of specified shape may be easily formed at low cost. The conductive filler in the conductive paint composition may be carbon particles, silver particles and others hitherto known, and the resin component such as epoxy and flurocarbon polymers is preferred to be excellent in durability to solvent, but extremely high durability against solvent is not needed because the position of the discharge electrode 8 is not directly exposed to thinner or other solvent, and known resins may be used.

However, such discharge electrodes 8 should not be formed, at least, to spread widely in all directions around the axis of rotation of the spray head main body 2 (that is, in the entire rear surface of the spray head main body). On the contrary, as shown in FIG. 2, they should be extended locally in only specific plural directions from the central side.

In the invention, moreover, it is desired that the tips of the discharge electrodes 8 are extended up to the outer peripheral edge of the spray head main body 2 as shown in FIG. 2. If the tips are terminated considerably before (the central side of) the outer peripheral edge of the spray head main body 2, atomized paint particles cannot be charged sufficiently, and the diameter of the discharge region formed before the spray head is small, and stable and sufficiently wide discharge region cannot be obtained.

The width of the tips of the discharge electrodes 8 is not particularly limited, but should be ⅕ or less of the diameter of the spray head main body 2, preferably about 0.5 to 5 mm. If the width of the tips of the discharge electrodes is wider than necessary, the distribution pattern of discharge current toward the object may not be averaged sufficiently.

In the invention, the plural discharge electrodes 8 are preferred to be connected to a common high voltage generator through mutually independent resistances of 10 kΩ to 500 MΩ. The reason why independent resistances are preferred between each electrode and high voltage generator is as follows: if a voltage drop occurs due to extraordinary corona discharge current at one electrode, the uniform corona discharge is not sufficiently grown in the other electrode, and such possibility must be eliminated. Such condition may be easily achieved by forming plural discharge electrodes employing thin films made from, for example, conductive paints with volume resistivity of about 10 kΩ-cm to 500 MΩ-cm.

In the rotary atomizing electrostatic coating apparatus of the invention, other constituent parts than the specified spray head main body 2 and discharge electrodes 8 may be formed in any mode of the hitherto known rotary atomizing electrostatic coating apparatus. For example, the motor for rotating the spray head main body 2 and discharge electrodes 8 may be any one of an electric motor by electric power and an air motor by air pressure. The high voltage generator may be any apparatus capable of generating a proper voltage depending on such driving method. The paint feed system may be properly selected depending on the type of paint, such as water base, organic solvent base, high solid type, two-component high solid type, and others, and a pump having a proper volume and discharge may be used, for example, a gear pump, and further a driving device for remote controlling the pump rotating speed, static mixer, and other mixing device may be appropriately employed. Still more, spark guard system, control device for monitoring the apparatus and stopping in case of emergency, constant voltage device, fire extinguishing equipment, other safety devices, various insulating parts, explosion-proof parts, and other known devices may be employed. To adjust the pattern of paint flow sprayed from the spray head, a pattern adjusting air mechanism may be also used. The rotary atomizing electrostatic coating apparatus of the present invention may be applied to paint spray system in any direction including upward, horizontal, and downward directions, and the method of installation may be stationary type, reciprocating type, or any other type.

(Second embodiment)

Figure 4:
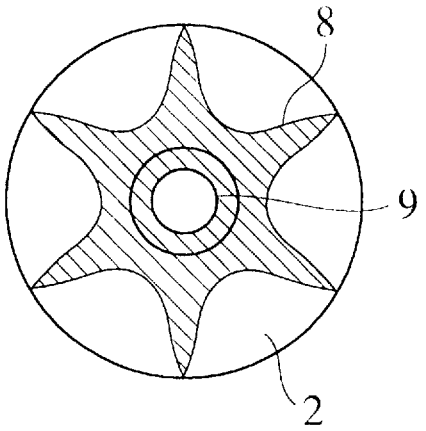
FIG. 4 is a back side view of a cup in a second embodiment of the invention.

FIG. 4 is a back side view of a cup 2 as spray head main body of a rotary atomizing electrostatic apparatus in a second embodiment of the invention. In the second embodiment, the constitution is same as in the first embodiment shown in FIGS. 1 to 3, except that the pattern of the conductive film 8 formed on the rear side of the cup 2 made of resin is changed as shown in the drawing in order to form six discharge electrodes. That is, in the second embodiment of the invention, the conductive film 8 encloses the whole circumference around an insert port 9 provided in the center of the cup 2 at the central side of the cup 2. And the conductive film 8 is extended radially, while gradually decreasing in width, toward six positions on the outer peripheral edge of the cup 2, having a mutual phase difference of about 60 degrees. The shape and material of the spray head main body 2 may be various as mentioned in the first embodiment. Also same as in the first embodiment, the discharge electrodes 8 may be composed of metal deposition film or metal thin film, as well as conductive film.

In FIG. 4, six electrodes are composed, but they may be also composed in a different quantity. In the second embodiment shown in FIG. 4, the conductive film for composing plural electrodes is not separate for each electrode but integral in the cup central part, or at the connection side with the hollow shaft connected to high voltage generator. However, it is also possible to form each electrode separately at this connection side, forming plural independent films corresponding to the number of electrodes (which is of course same also in the first embodiment). In the second embodiment of the invention, whether the plural discharge electrodes are formed separately or not will not matter much. Anyhow, it is important that the plural discharge electrodes 8, each having a nearly band-form pattern extended outward almost along the rear side shape of the spray head main body from the central side of the spray head main body 2, are disposed having a mutual phase difference about the axis of rotation of the spray head 2.

Herein, "plural discharge electrodes, each having a nearly band-form pattern are disposed" should not be understood in a strict sense of meaning "discharge electrodes formed of nearly band-shape conductor or conductive film are existing in a plurality, independently of each other", but should be understood in a broader sense of meaning "leading ends (tips) with narrow width of each discharge electrode are existing in a plurality", that is, "discharge tips are existing in a plurality, independently of each other, but they may not be necessarily independent of each other at the connection side with the high voltage generator of each electrode (positioned at the central side)". We regard as the discharge electrodes are "plural" as far as the plural pairs of contour lines of a certain length portion reaching the tip positions are existing and converging or directing to the tip portion from the central side (axis of rotation of spray head)." That is, "plural discharge electrodes" in the invention means there are plural discharge ends (tips) of narrow width to cause concentration of electric field, disposed apart from each other in the rotating direction, as electrical action relating to corona discharge (actually, however, it does not mean that corona discharge occurs only in such discharge tips). Namely, and the conductors or conductive films for composing such plural discharge electrodes themselves may be integral as shown in FIG. 4 (or FIG. 2). In short, only the discharge tip neighboring positions may be understood as electrical "discharge electrodes," and the further central sides may be interpreted as mere accompanying conductive parts with the high voltage generator side. Of course, the band-shaped conductors or conductive films may be completely independent.

The term "band-form pattern" only means the pattern extending from the center and forming the leading end (tip) of narrow width without having an extraordinal edge on the way so as to be easy to cause concentration of electric field. And it does not mean only the shape extended in the same width, it includes the shape gradually decreased in width in linear or curved profile. And it also includes arc or certain curve, not limited to the linearly extended form in the radial direction from the central side. In particular, since the concentration of electric field is more likely to occur stably in the tip of the discharge electrodes, and the shape gradually decreased in width toward the tip is particularly preferred.

In the rotary atomizing electrostatic coating apparatus according to the second embodiment of the invention, the number of discharge electrodes 8 is not limited to six. A plurality of discharge electrodes 8 may be disposed symmetrically about the axis of rotation of the spray head main body 2 as shown in FIG. 4. That is, regarding the rear side of the spray head main body 2 as a planar surface (circle), each discharge electrode 8 must be present only in a region of a specific width at right and left side of the line linking the central point of this circle and a certain point on the circle. Further, the nearly band-form discharge electrodes 8 must be axis-symmetrical. As far as these conditions are satisfied, the number is not limited to six. For example, a plurality of discharge electrodes may be present in such configuration that the discharge electrodes are present at positions mutually rotated by about 120 degrees in the case of three discharge electrodes, the discharge electrodes are present at positions mutually rotated by about 90 degrees in the case of four discharge electrodes, and so forth. By disposing thus symmetrically about the axis of rotation of the spray head main body 2, by rotation of the spray head main body 2 and the discharge electrodes 8, the discharge electrodes rotate at every same interval in any direction about the axis of rotation, so that a uniform discharge electric field can be formed about the axis of rotation of the spray head.

Figure 5:
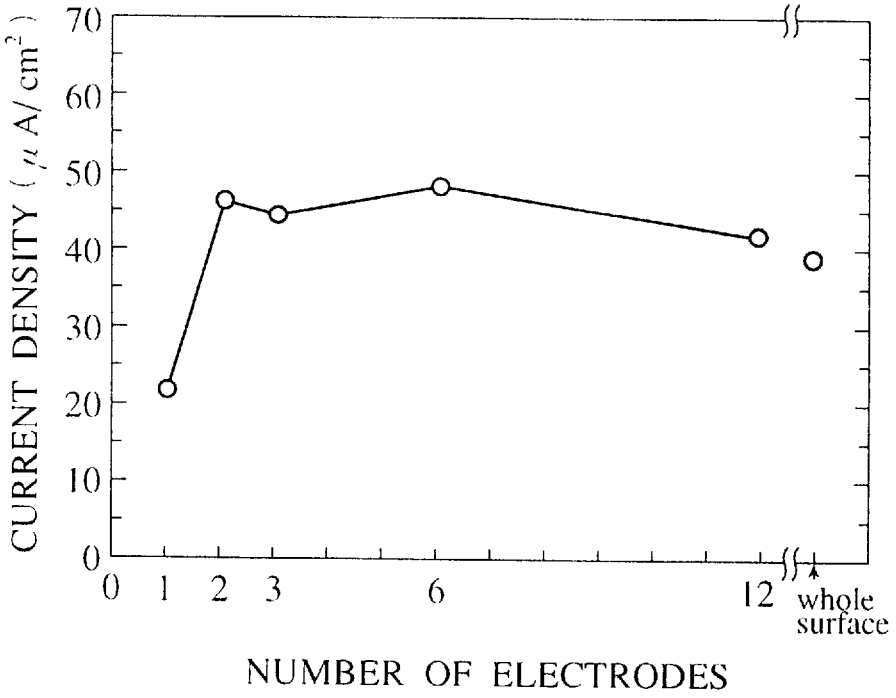
FIG. 5 is a graph showing difference in current density of corona discharge towards the object (within a range of 300 mm in radius from the central part of a spray head) due to difference in the number of electrodes.

FIG. 5 shows the difference in current density of corona discharge toward the object to be painted by difference in the number of electrodes. In the method of measurement, a metal disk of 300 mm in radius was installed on the front direction of the cup (50 mm in diameter) by insulating and supporting (at a distance of 200 mm to the cup), this disk was installed with an ammeter, and the current value flowing in the corona discharge was converted to the value per unit area of the disk. Incidentally, the discharge electrodes provided on the rear side of the resin cup 2 as spray head main body are formed of conductive paint film as mentioned above. The measurements are executed for the case, that the number of discharge electrodes of the invention is 2, 3, 6 or 12, each discharge electrode is disposed so as to be symmetrical about the axis of rotation of the cup. And the measurement for the case of one discharge electrode only, the electrode is extended in one direction only of the radial direction from the cup center. By way of comparison, further, similar measurements were attempted by using a conventional metal cup having same shape. In FIG. 5, "whole surface" means the case of using this metal cup. As clear from FIG. 5, in the case of 2 to 12 electrodes, the current density toward the object is increased, and the effect of the invention is known. In particular, in the case or 2 and 6, the increase of the current density is obvious. The reason of excluding the case of one electrode only in this invention is clear also from this result of measurement. As shown in FIG. 5, in the case of one electrode, the discharge current is smaller than the case with the whole surface electrode represented by the metal cup.

Figure 6:
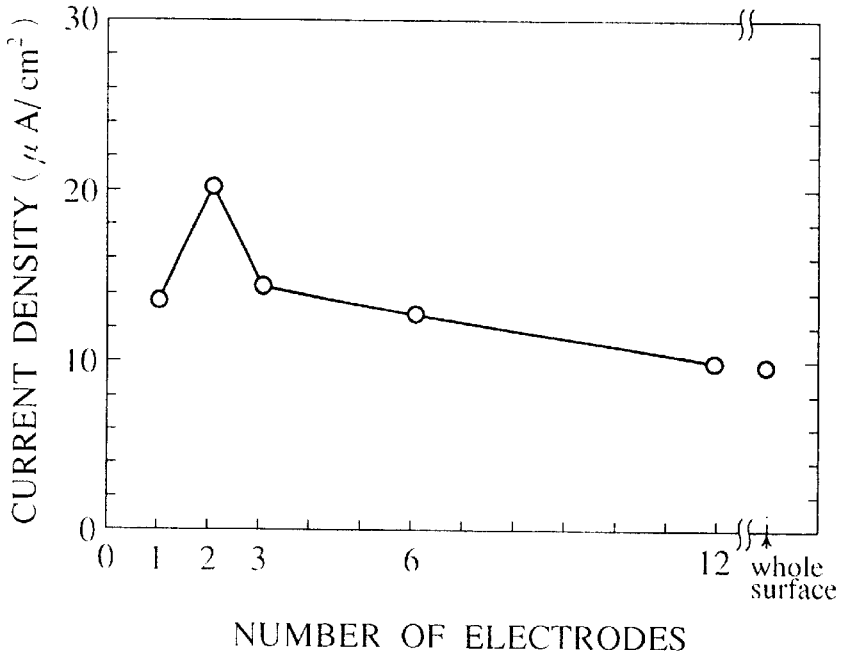
FIG. 6 is a graph showing difference in current density corona discharge towards the object (within a range of 100 mm in radius from the central part of a spray head) due to difference in the number of electrodes.

FIG. 6 shows the discharge current density within a cylindrical area having a radius of 100 mm, surrounding radius of the rotation axis of the cup, i.e., the variation of the discharge current density between the cup front surface and the object due to the difference in the number of electrodes. In measurement, a disk of 100 mm in radius was installed toward the cup front direction by insulating and supporting, this disk was installed with an ammeter, and the current flowing due to corona discharge was converted to the value per unit area of the disk. To prevent changes of distribution profile of corona discharge by the electrode shape, a disk of 105 mm in inner radius and 300 mm in outer radius was installed on the same plane of the cup front surface, and was used as a guard electrode. The other conditions were same as in FIG. 5. As shown in FIG. 6, the discharge current toward the cup front direction tends to increase as the number of electrodes is smaller, except for the case of one electrode only. Between the measurements for the case with number of electrodes exceeding 12 and the whole surface electrode, there is no significant difference in the discharge current flow, and considering the labor of manufacturing, there is no merit of setting more than 12 electrodes.

Figure 7:
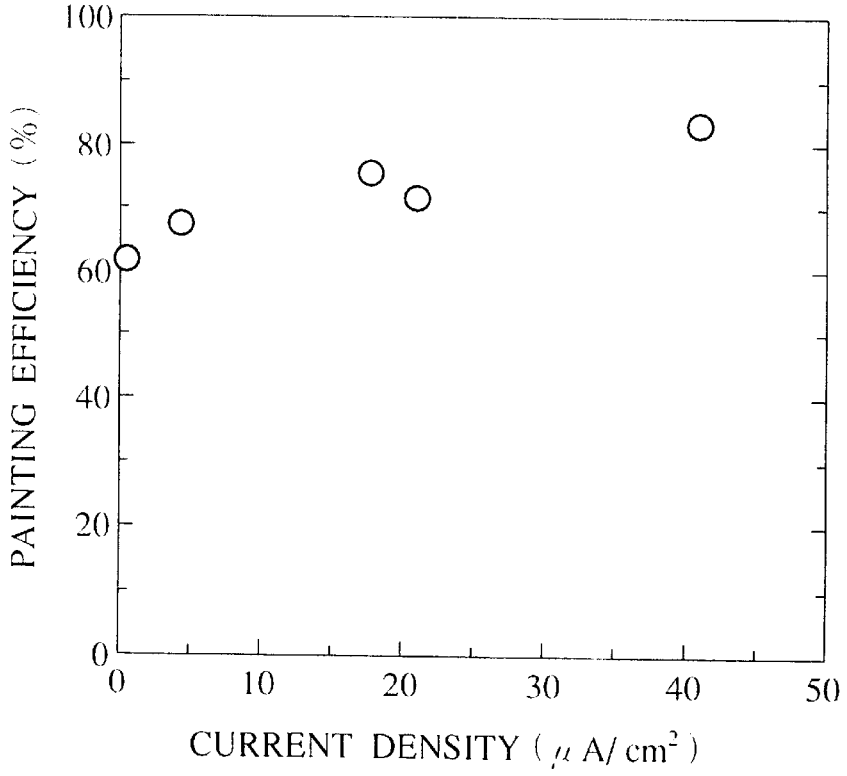
FIG. 7 is a graph showing the relation of discharge current density and paint deposition efficiency in the case of coating by the rotary atomizing electrostatic coating apparatus.

FIG. 7 shows the relation between the discharge current density and painting efficiency (paint deposition efficiency) in the case of painting by the rotary atomizing electrostatic coating apparatus. It is known from FIG. 7 that the painting efficiency is higher when the discharge current is more. As already explained, according to the rotary atomizing electrostatic coating apparatus having the constitution of the present invention, the discharge current increases. Hence, it is evident that the painting efficiency is enhanced by the present invention.

In the second embodiment of the invention, the plural discharge electrodes 8 are preferred to be connected to a common high voltage generator through mutually independent resistances of 10 kΩ 500 MΩ. The reason why independent resistances are preferred between each electrode and high voltage generator is that we must eliminate the possibility of the situation in which, as mentioned in the first embodiment, unexpected voltage drop occurs due to extraordinary corona discharge current generated in one electrode, and corona discharge is not sufficiently grown in the other electrode, so that a stabler corona discharge current is obtained. Such condition may be easily achieved by forming a thin conductive film for composing the plural discharge electrodes by employing, for example, a conductive paint having volume resistivity of about 10 kΩ-cm to 500 MΩ-cm on a thin film.

In the second embodiment of the invention, the width of the tips of the plural discharge electrodes 8 is preferred to be ⅕ or less of the diameter of the spray head main body 2. This is because the distribution pattern of discharge current is averaged more uniformly.

(Third embodiment)

In the foregoing first and second embodiments, the discharge electrodes provided at the rear side of the spray head are in direct contact with the rear side of the spray head, but the discharge electrodes may be also formed separately at a specific distance from the rear side of the spray head, for example, about 1 to 10 mm.

Figure 8:
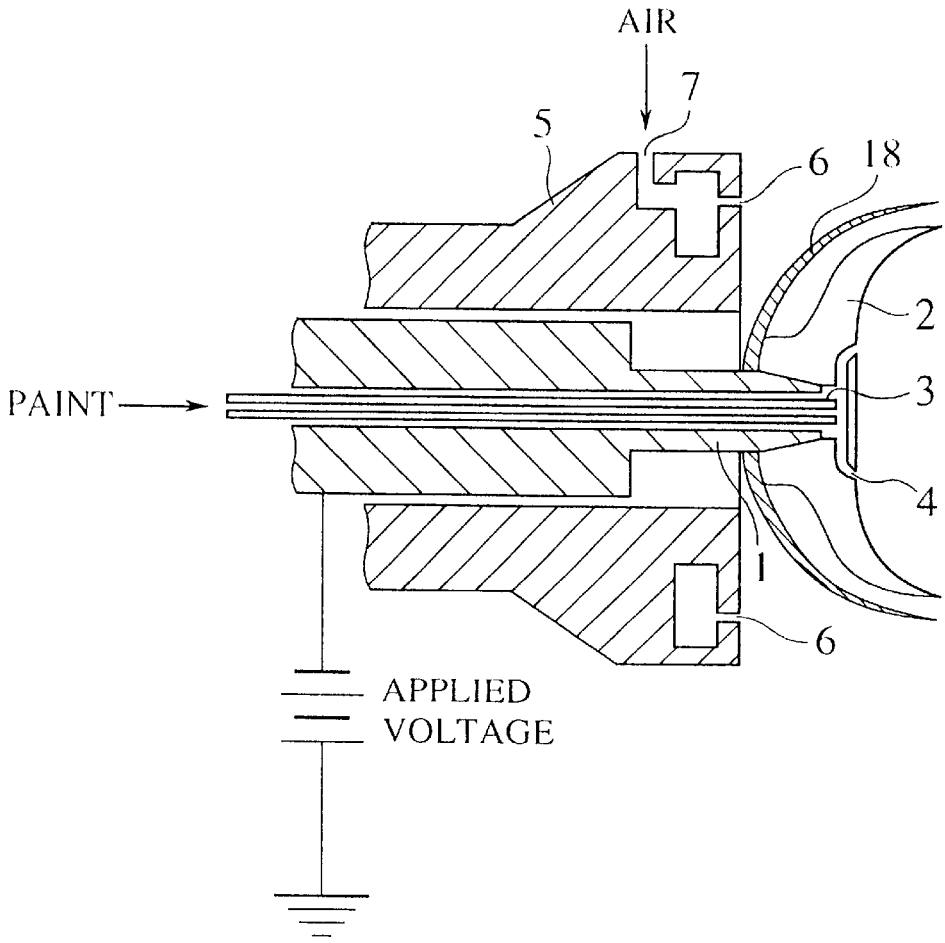
FIG. 8 is a schematic cross-sectional view of a leading end part of a rotary atomizing electrostatic coating apparatus in a third embodiment of the invention.
Figure 9:
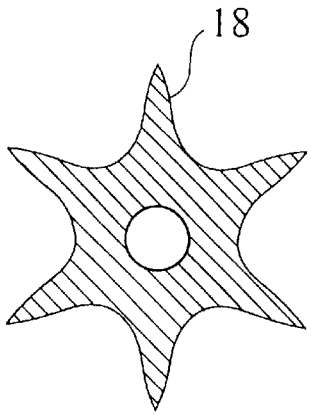
FIG. 9 is a front view of a discharge electrode in the third embodiment.

FIG. 8 is a schematic cross-sectional view of the leading end part of a rotary atomizing electrostatic coating apparatus in a third embodiment of the invention, and FIG. 9 is a front view of its discharge electrode 18. In the third embodiment of the invention, the discharge electrode 18 provided at the rear side of the resin cup 2 as the spray head main body is a metal discharge electrode 18 formed separately from the cup 2, and other constitution is same as in the first and second embodiments. Of the reference numerals in FIG. 9, those same as in FIG. 1 refer to same members as in FIG. 1.

That is, in the third embodiment of the invention, at the rear side of the resin cup 2 as the spray head main body fixed at the leading end of the hollow shaft 1 of a motor incorporated in the apparatus, the metal electrode plate 18 as discharge electrode is fixed by inserting the hollow shaft 1 into the opening provided in the (enter as shown in FIGS. 8 and 9. The metal electrode plate 18 has portions extended outward while decreasing in the width gradually. And the metal electrode plate extends toward six directions mutually having a phase difference of about 60 degrees, from the annular portions enclosing the whole circumference of the opening provided in the center as shown in FIG. 9. The surface plane of the discharge electrode bends almost along the rear side shape of the cup 2 as shown in FIG. 8, and the longest portions (tip positions) existing in the six directions are positioned near the outer peripheral edge of the cup. Therefore, the shape of the discharge electrode 18 in the third embodiment of the invention is nearly same as the discharge electrodes formed of conductive film in the second embodiment shown in FIG. 4.

As shown in FIG. 8, when forming the discharge electrode 18 separately from the spray head main body, for example, various thin metal plates of steel, stainless steel, chrome steel, aluminum, aluminum alloy, copper and the like may be formed in specified shape, or the discharge electrode may be formed by casting or the like. The discharge electrode may be also formed by covering locally the surface of an arbitrary core insulating material in a specified shape with a conductive film such as thin metal film.

As in the third embodiment of the invention, when the discharge electrode 18 is formed separately from the cup (spray head main body) 2, if the shape, especially, the number of electrodes is same, the features about the discharge current are same as in the case of forming the discharge electrode closely contacting the cup rear side by using conductive paint or the like, but in this case the discharge position can be set independently of the cup, which is an extra advantage. Needless to say, the number of discharge electrodes 18 in the third embodiment of the invention is not limited to six. The number of discharge electrodes is preferred to be 2 to 12. If the number of electrodes is more than 12, as explained in the second embodiment, as compared with the cases of using the metal spray head as in the prior art, or disposing a cylindrical or disk-shaped discharge electrode to cover the entire rear side of the insulating spray head, any particular beneficial effect is not obtained (see FIGS. 5, 6). Also in the third embodiment, as the number of discharge electrodes, only one is excluded. The reason is that in the case of a single electrode, as compared with the case of disposing the discharge electrode having a surface extended in all directions around the axis of rotation of the spray head, the discharge current tends to decrease.

The rotary spray head of the rotary atomizing electrostatic coating apparatus in the third embodiment of the invention is can be used only by replacing the metal spray head used in the conventional rotary atomizing electrostatic coating apparatus with the insulating spray head main body 2 and the discharge electrode 18 of the invention. Therefore, without substantially changing the other portions, the existing apparatus can be improved structurally easily by increasing the corona discharge current density and averaging the current distribution profile, and hence the painting efficiency can be enhanced.

Various modifications will become possible for those skilled in the art after receiving the teachings of the present disclosure without departing from the scope thereof.

What is claimed is:

1. A rotary atomizing electrostatic coating apparatus having a rotating spray head comprising:

(a) a spray head main body made of an electrically insulating material, said main body having a front surface and a rear surface; and (b) a plurality of discharge electrodes, each having a nearly band-form pattern extended outward approximately along the rear surface of the spray head main body from a central side of said spray head main body, said plurality of discharge electrodes disposed with a specific mutual phase difference, the plurality of discharge electrodes rotatable together with said spray head main body;

wherein said spray head throws atomized paint in the direction of the said front surface of said spray head; wherein said plurality of discharge electrodes are disposed at the rear surface of said main body.

2. A rotary atomizing electrostatic coating apparatus of claim 1, wherein said spray head main body is in a form of a cup.

3. A rotary atomizing electrostatic coating apparatus of claim 1, wherein said discharge electrodes are composed of a conductive material closely contacting with the rear side of said spray head main body.

4. A rotary atomizing electrostatic coating apparatus of claim 3, wherein said discharge electrodes are protruding from the outer peripheral edge of said spray head.

5. A rotary atomizing electrostatic coating apparatus of claim 1, wherein said plurality of discharge electrodes are connected to a common high voltage generator through mutually independent resistances of 10 kΩ to 500 MΩ.

6. A rotary atomizing electrostatic coating apparatus of claim 1, wherein the number of said plurality of discharge electrodes is 6 or 2.

7. A rotary atomizing electrostatic coating apparatus of claim 1, wherein the width of the tips of said discharge electrodes is ⅕ or less of the diameter of said spray head main body.

8. A rotary atomizing electrostatic coating apparatus having a rotating spray head comprising:

(a) a spray head main body made of an electrically insulating material, said main body having a first surface and a second surface; and (b) a plurality of discharge electrodes, each having nearly band-form pattern extended outward approximately along the second surface of the spray head main body from a central side of said spray head main body, said plurality of discharge electrodes disposed symmetrically about the axis of rotation of said spray head main body, the plurality of discharge electrodes rotatable together with said spray head;

wherein said spray head throws atomized paint in the direction of said first surface of said spray head; wherein said plurality of electrodes are disposed at the second surface of said main body.

9. A rotary atomizing electrostatic coating apparatus having a rotating spray head comprising:

(a) a spray head main body made of an electrically insulating material; and (b) a plurality of discharge electrodes having a nearly band-form pattern extending outward approximately along the rear side shape of the spray head main body from a central location of said spray head main body, the plurality of discharge electrodes disposed with a specific mutual phase difference, the plurality of discharge electrodes rotatable together with said spray head main body;

wherein said discharge electrodes are composed of a conductive material closely contacting the rear side of said spray head main body.

10. A rotary atomizing electrostatic coating apparatus having a rotating spray head comprising:

(a) a spray head main body made of an electrically insulating material; and (b) a plurality of discharge electrodes, each having a nearly band-form pattern extended outward approximately along a rear side shape of the spray head main body from the central side of said spray head main body, the plurality of discharge electrodes disposed symmetrically about the axis of rotation of said spray head main body, the plurality of discharge electrodes rotatable together with said spray head;

wherein said discharge electrodes are composed of a conductive material closely contacting with the rear side of said spray head main body.

* * * * *